US006243542B1

(12) United States Patent
Fujimoto et al.

(10) Patent No.: US 6,243,542 B1
(45) Date of Patent: Jun. 5, 2001

(54) SYSTEM FOR CONTROLLING THE DENSITY OF TONER IMAGES IN AN IMAGE FORMING APPARATUS

(75) Inventors: Akihiro Fujimoto, Mishima; Atsuhiko Yamaguchi, Shizuoka-ken, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/459,481

(22) Filed: Dec. 13, 1999

(30) Foreign Application Priority Data

Dec. 14, 1998 (JP) ..... 10-355042
Feb. 4, 1999 (JP) ..... 11-027700

(51) Int. Cl.[7] ..... G03G 15/00
(52) U.S. Cl. ..... 399/49; 399/72
(58) Field of Search ..... 358/296, 298, 358/300; 399/8, 11, 49, 50, 51, 38, 46, 55, 72

(56) References Cited

U.S. PATENT DOCUMENTS 5,583,644 12/1996 Sasanuma et al. ..... 358/296
5,950,036 * 9/1999 Konishi ..... 399/8
6,021,288 * 2/2000 Okuno et al. ..... 399/72
6,034,788 * 3/2000 Sasanuma et al. ..... 358/406
6,044,234 * 3/2000 Yoshizawa ..... 399/49

* cited by examiner

*Primary Examiner*—Fred L Braun
*Assistant Examiner*—Hoang Ngo
(74) *Attorney, Agent, or Firm*—Fitzpatrick, Cella, Harper & Scinto

(57) ABSTRACT

In general, an image forming apparatus for transferring an image formed on an image carrier onto a recording sheet can attain higher-accuracy control by density control based on the patch density detected on a recording sheet after fixing than the patch density formed on the image carrier. In this case, recording sheets are wasted. Since a calibration process is executed at a predetermined timing, calibration is executed even during execution of a print job, in which calibration is not preferable. In this invention, whether a patch formed on an intermediate transfer member or recording sheet is detected is selected in accordance with a set control mode, and density control is done based on the obtained patch density, thus selectively executing density control that saves recording sheets, and more accurate density control using recording sheets. Since a print job is started after calibration is forcibly executed based on a user instruction, the calibration is never executed during the job.

24 Claims, 12 Drawing Sheets

SYSTEM FOR CONTROLLING THE DENSITY OF TONER IMAGES IN AN IMAGE FORMING APPARATUS

BACKGROUND OF THE INVENTION

The present invention relates to an image forming apparatus and its control method and, more particularly, to an image forming apparatus for performing density control upon forming an image and its control method.

In general, in an image forming apparatus that forms a full-color image, the density of the formed image may vary in accordance with various conditions such as its use environment, the accumulated number of prints, and the like and, in such case, correct tone color of the image itself cannot be obtained.

To solve this problem, in order to detect the current image forming state, a conventional image forming apparatus tentatively forms toner images for density detection (to be referred to as patches hereinafter) in units of colors on a photosensitive drum or intermediate transfer member at a predetermined timing (e.g., immediately after power ON or after a predetermined number of prints are formed), automatically detects their densities, and executes a color correction (calibration) process based on the image forming state, thus maintaining stable image quality and image accuracy.

For example, an apparatus for forming an image using an intermediate transfer member will be explained below. As shown in FIG. 8, color patch patterns based on the first developing bias are formed on a print region on the intermediate transfer member from an image write start position, and after that, color patch patterns are formed in turn up to those based on the N-th developing bias. The densities of the patch patterns are detected by a toner density sensor, and the detection results are fed back to image forming conditions such as an exposure amount, developing bias, and the like to execute density control so as to form a color image with an original density, thus obtaining a stable image.

In this manner, as one of methods for calibrating based on the actual measurement results of patch densities, a method of optimizing the developing bias is known. Normally, the relationship between the developing bias and density in an image forming apparatus is readily influenced by the number of prints, and environmental changes such as changes in temperature, humidity, and the like, and changes over time. For this reason, by forming a plurality of patches shown in FIG. 8 while changing the developing bias and measuring the densities of the patches every predetermined number of prints, the developing bias value that can obtain a predetermined density in the current environment is estimated.

However, as is known, density control based on the toner density detected on a recording sheet after fixing can assure higher accuracy than that executed by detecting the toner densities of patches formed on a photosensitive drum or intermediate transfer member. That is, the toner density control of an output image itself after image formation can obtain higher image quality than that in the middle of image formation.

Hence, in order to detect the toner density on a recording sheet after fixing, patches may be transferred onto the recording sheet and fixed, and their toner densities may be detected at a paper exhaust unit. However, in this case, a recording sheet is wasted every time density control is done.

In addition to calibration by density control based on the detection result of patch densities, for example, the following calibration methods are known:

- a method of forming patches while changing the laser exposure amount, and preparing a laser exposure amount correction table based on the detected densities;
- a method of forming patches while changing process conditions such as a photosensitive drum potential and the like, and estimating optimal process conditions on the basis of the detected densities;
- a method of forming position detection patches of individual colors on an intermediate transfer member, and correcting the image forming positions (registration) of the individual colors by detecting their positional relationship using a sensor; and
- a method of uniformly charging the surface of a photosensitive drum by a charger or the like, detecting deterioration of the photosensitive drum by measuring the charged potential of the photosensitive drum at that time by a sensor, and adjusting the charging bias value.

The conventional image forming apparatus executes optimal calibration using one of the aforementioned methods or combining a plurality of ones of those methods.

However, upon examining images formed before and after the calibration, stable image quality and image accuracy can be obtained after the calibration, but the image quality such as the image density and image accuracy considerably differ immediately before and after the calibration.

Hence, when the calibration is executed every predetermined number of prints, it may be executed in the middle of a series of print processes for copying a single original in large quantity. In such case, print results considerably vary before and after the calibration process although similar print processes are made.

Also, a considerable processing time is required for executing the calibration. Hence, when the calibration is unconditionally executed at a predetermined timing (e.g., at the beginning of printing, every predetermined number of prints, or the like), the processing time is prolonged even when the current print process requires high processing speed rather than high image quality or image accuracy.

SUMMARY OF THE INVENTION

Accordingly, it is an object of the present invention to provide an image forming apparatus which can selectively execute density control that can save recording sheets, and more accurate density control using a recording sheet, and its control method.

According to the present invention, the foregoing object is attained by providing an image forming apparatus comprising:

- image forming means for forming an image on an image carrier, and transferring the image onto a recording sheet;
- test image forming means for making the image forming means form a test image;
- first density detection means for detecting a density of the test image formed on the image carrier;
- second density detection means for detecting a density of the test image formed on the recording sheet; and
- control means for controlling an image forming condition in the image forming means, wherein the control means controls the image forming condition by selectively using the first and second density detection means in accordance with a control mode based on a user instruction.

In this manner, since a plurality of toner density measurement means are provided, density control that saves recording sheets, and more accurate density control that uses a recording sheet can be selectively executed.

It is another object of the present invention to provide an image forming apparatus which can arbitrarily control the execution timing of a calibration process, and its control method.

According to the present invention, the foregoing object is attained by providing an image forming apparatus comprising:

image forming means for forming an image on the basis of an image signal;

control means for controlling an image forming condition in the image forming means in a first mode; and instruction input means for inputting a user instruction, wherein the control means controls the image forming condition in a second mode when the instruction input means instructs to control the image forming condition.

Note that the first mode is a mode for automatically executing the image forming condition control at a predetermined timing, and the second mode is a mode for executing the image forming condition control at an instruction input timing by the instruction input means.

In this manner, since the execution timing of the calibration process can be arbitrarily controlled, the user can stably obtain a high-quality image at a desired timing.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Preferred embodiments of the present invention will now be described in detail in accordance with the accompanying drawings.

<First Embodiment>

General Apparatus Arrangement

Figure 7:
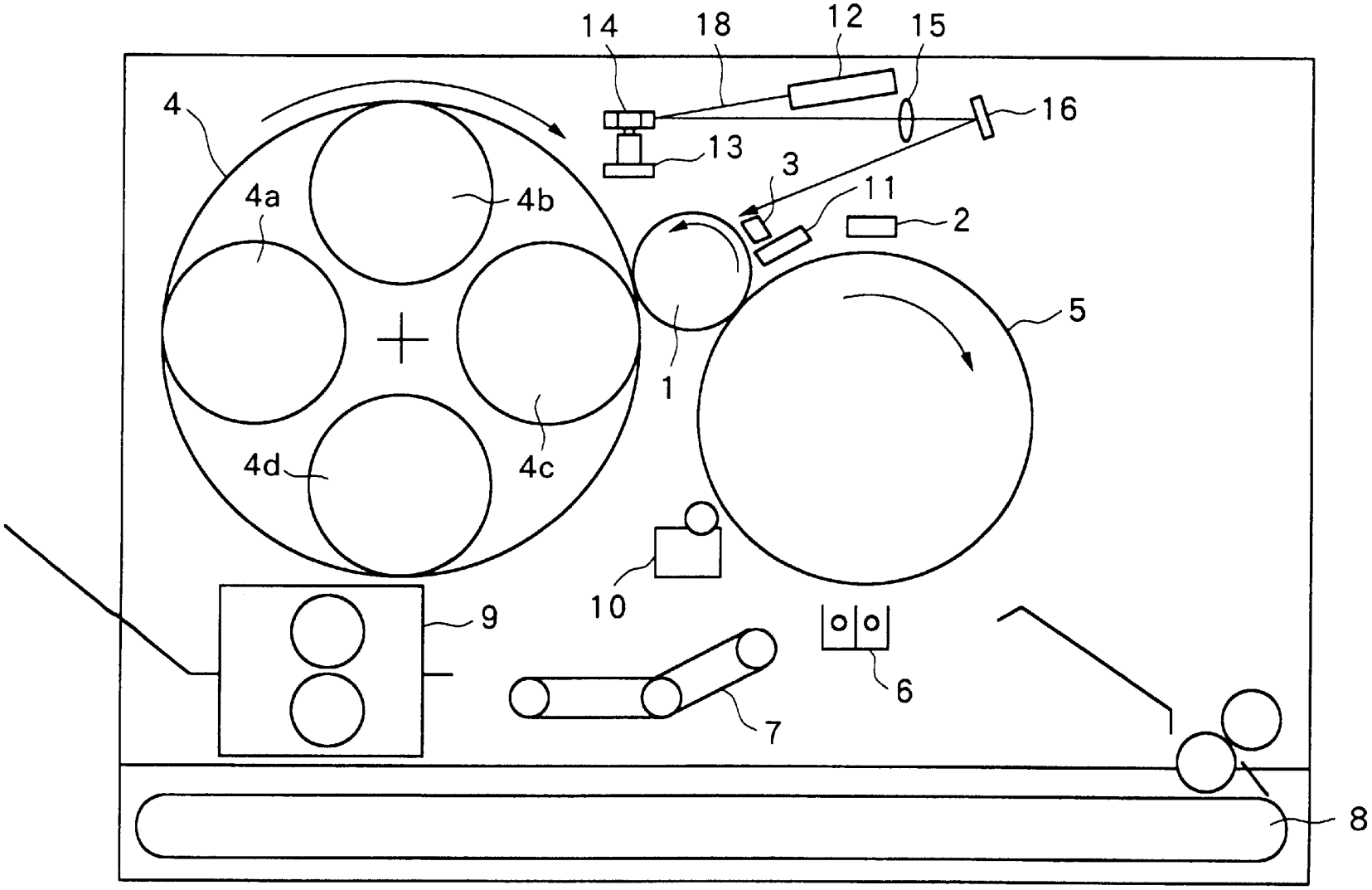
FIG. 7 is a side sectional view of a general image forming apparatus.
Figure 8:
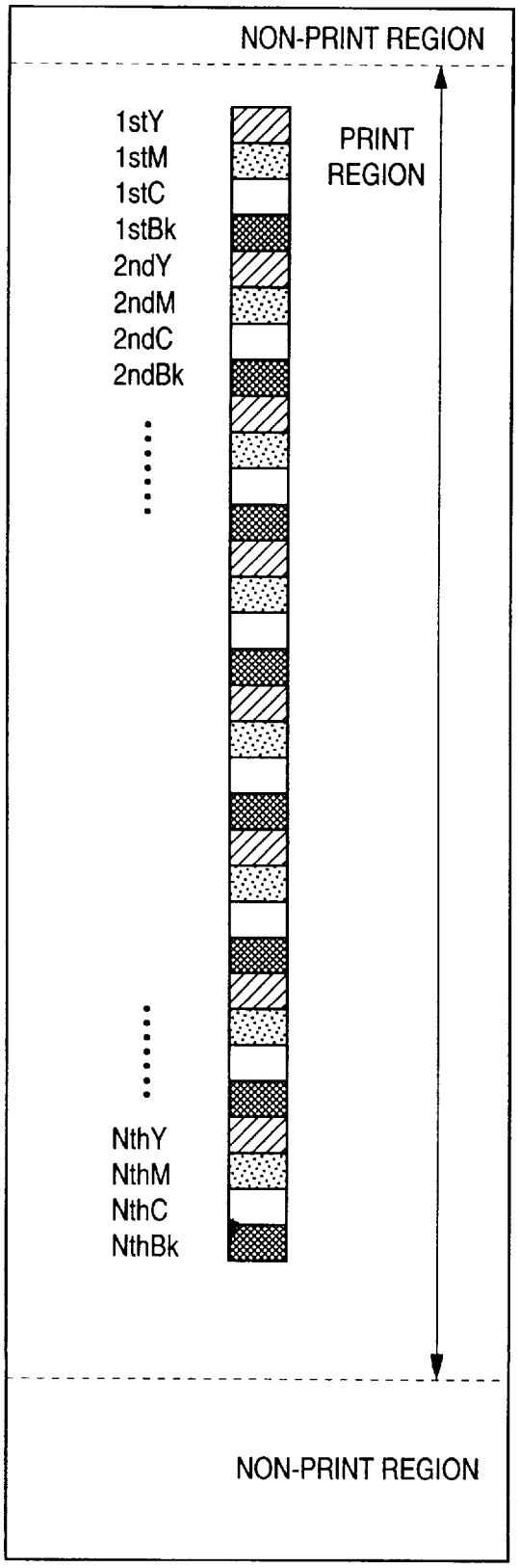
FIG. 8 shows an example of patch patterns in the general image forming apparatus.

A general arrangement of a color image forming apparatus will be explained first. FIG. 7 is a block diagram showing the arrangement of a general color image forming apparatus. Referring to FIG. 7, a photosensitive drum 1 is equipped at nearly the center in the apparatus, and is rotated by a driving means (not shown) in the direction of an arrow in FIG. 7. A charger 3 is equipped near the upper right side of the outer circumferential surface of the photosensitive drum 1. Furthermore, a plurality of developers 4*a*, 4*b*, 4*c*, and 4*d* are carried by a rotatable supporting member 4 on the left side of the photosensitive drum 1.

A laser diode 12, a polygonal mirror 14 rotated by a high-speed motor 13, a lens 15, and a return mirror 16, which build an exposure device, are located in the upper portion in the apparatus main body.

When a signal according to yellow (Y) image information is input to the laser diode 12, the photosensitive drum 1 is irradiated with optical information corresponding to Y via an optical path 18, thus forming a latent image on the drum 1. Furthermore, when the photosensitive drum 1 rotates in the direction of the arrow in FIG. 7, the latent image is visualized as a Y toner image by the developer 4*a*. The toner image on the photosensitive drum 1 is then transferred onto an intermediate transfer member 5.

By repeating the aforementioned process also for magenta (M), cyan (C), and black (K), a full-color image is formed on the intermediate transfer member 5 by a plurality of color toner images. After that, when the plurality of color toner images on the intermediate transfer member 5 have reached a transfer position of a transfer charger 6, the toner images are transferred onto a recording sheet fed to that transfer position. The toner images that have been transferred onto the recording sheet are melted and fixed by a fixing unit 9, and that recording sheet is exhausted outside the apparatus, thus obtaining a color image print. Note that the recording sheet is not limited to a normal paper sheet, but may be other media such as an OHP sheet, envelope, postcard, and the like.

On the other hand, the residual toner on the photosensitive drum 1 is cleaned by a cleaning device 11 such as a fur brush, blade means, or the like. Also, the residual toner on the intermediate transfer member 5 is cleaned by a cleaning device 10 such as a fur brush, web, or the like that removes the residual toner by rubbing the surface of the intermediate transfer member 5.

Note that reference numeral 2 denotes a toner density sensor which detects the density of a toner image of each color formed on the intermediate transfer member 5.

In the image forming apparatus shown in FIG. 7, calibration is done as follows. For example, color patch patterns based on the first to N-th developing biases are formed from an image write start position on a print region of the intermediate transfer member 5, and their densities are detected by the toner density sensor 2. The detection results are fed back to image forming conditions such as an exposure amount, developing bias, and the like, thus making density control.

Apparatus Arrangement of First Embodiment

Figure 1:
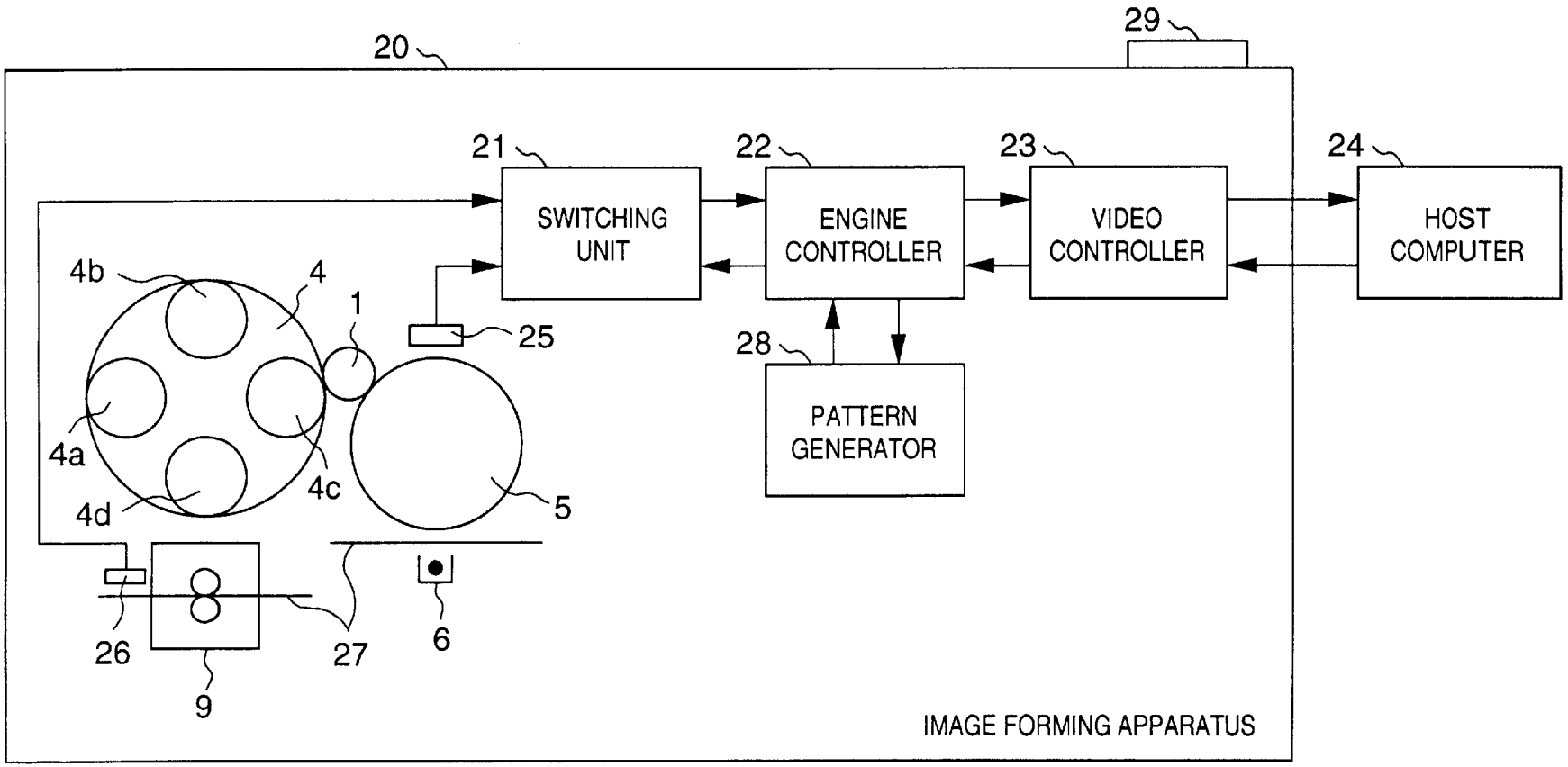
FIG. 1 is a block diagram showing the arrangement of an image forming apparatus according to the first embodiment of the present invention.

FIG. 1 is a block diagram showing the arrangement of a color image forming apparatus according to this embodiment. The same reference numerals in FIG. 1 denote the same parts as in FIG. 7 that shows the aforementioned arrangement of the general color image forming apparatus, and a detailed description thereof will be omitted. Only the characteristic features of this embodiment will be explained.

Referring to FIG. 1, reference numeral 20 denotes an image forming apparatus main body; and 24, a host computer as an external apparatus. As in the arrangement shown in FIG. 7, the image forming apparatus 20 comprises the photosensitive drum 1, developers 4*a*, 4*b*, 4*c*, and 4*d*, intermediate transfer member 5, and transfer charger 6.

Reference numeral 25 denotes a density sensor A for detecting the patch density on the intermediate transfer member 5. The density sensor A is equipped above the outer circumferential surface of the intermediate transfer member 5. Reference numeral 26 denotes a density sensor B for detecting the patch density on a recording sheet 30 after fixing. The density sensor B is equipped near an exhaust unit after the recording sheet has passed through the fixing unit 9. The density sensor A 25 in this embodiment corresponds to the toner density sensor 2 in the general arrangement shown in FIG. 7.

Reference numeral 21 denotes a switching unit for switching the outputs from the density sensors A 25 and B 26. Reference numeral 22 denotes an engine controller which includes a CPU, ROM, and RAM, and systematically controls the building members that implement the aforementioned image forming operation.

Reference numeral 23 denotes a video controller for controlling transfer of video data sent from the host computer 24 to the engine controller 22. Note that the incoming video data is encoded, and is decoded to have 8-bit density information for each of four colors Y, M, C, and K. The video controller 23 also performs communication control for receiving a signal from the engine controller 22, informing the host computer 24 of a print state, and so forth.

Reference numeral 28 denotes a pattern generator for generating predetermined grayscale patch pattern signals in units of colors upon executing density control in accordance with an instruction from the engine controller 22.

Reference numeral 29 denotes a console which comprises a display such as a touch panel or the like, which allows the user to input instructions and informs apparatus status and the like.

In this embodiment, the apparatus has a "normal print mode" for performing normal density control, i.e., density control on the basis of the density detection results of the density sensor A 25, and a "detailed print mode" for performing more accurate density control on the basis of the density detection results of the density sensor B 26. The engine controller 22 controls to select these normal and detailed print modes on the basis of, e.g., a command or the like input from the host computer 24 via the video controller 23.

Figure 2:
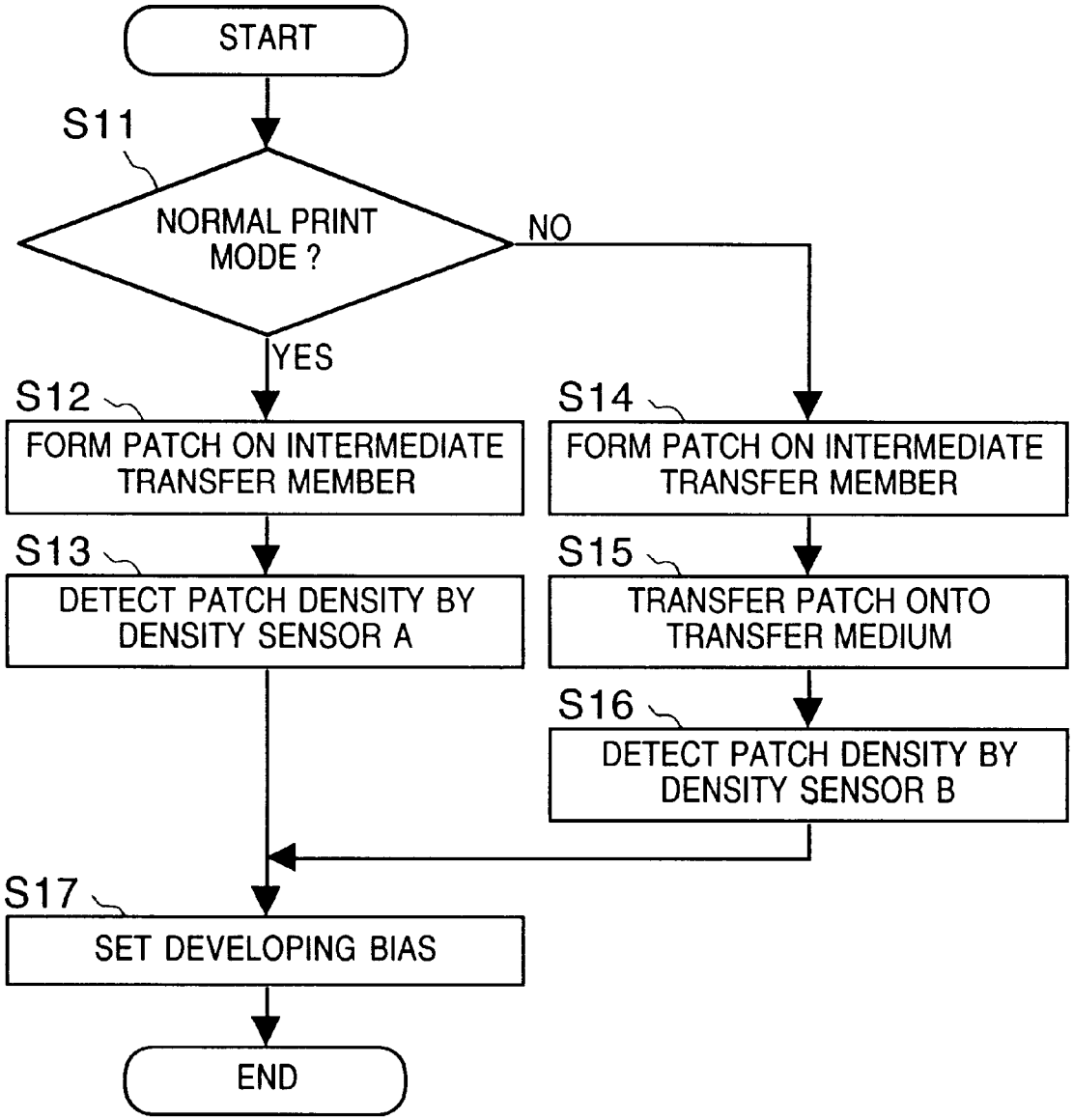
FIG. 2 is a flow chart showing a density control process in the first embodiment.

The density control process in this embodiment will be explained below with reference to the flow chart in FIG. 2. Note that the process shown in that flow chart is implemented by the control of the engine controller 22.

Figure 3:
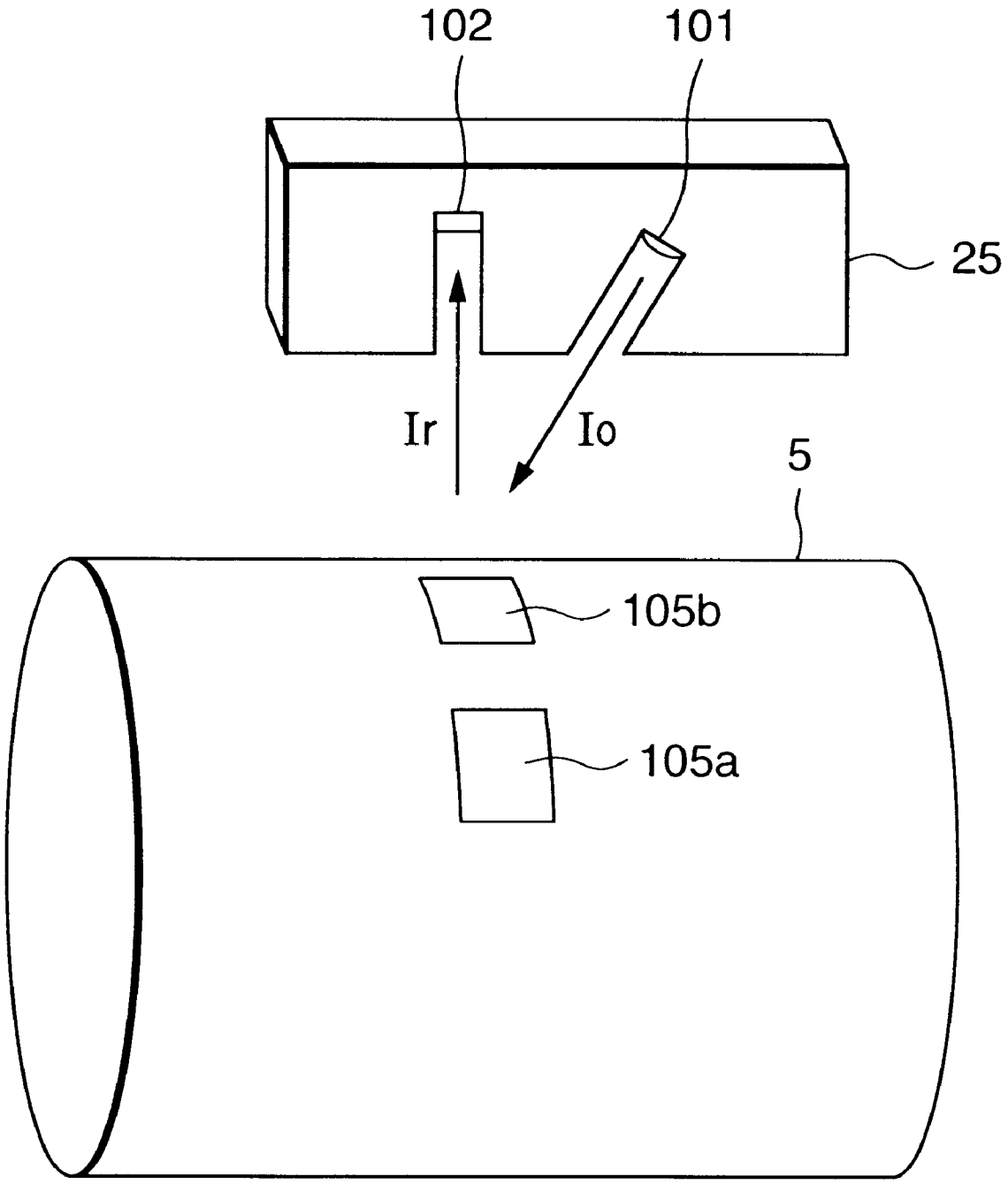
FIG. 3 shows patches formed on an intermediate transfer member in the first embodiment.

A case will be exemplified below wherein the "normal print mode" is selected in step S11. In this case, in step S12, a plurality of patches 105 (105*a*, 105*b*) are formed on the intermediate transfer member 5 to have density differences by changing the developing bias with respect to a pattern having a given density, as shown in FIG. 3. Note that the patches 105 are formed based on an image signal output form the pattern generator 28.

In step S13, the density sensor A 25 detects these patch densities. More specifically, as shown in FIG. 3, the density sensor A 25 comprises a light-emitting unit 101 and light-receiving unit 102, the patches 105 on the intermediate transfer member 5 are irradiated with light rays Io from the light-emitting unit 101, and light Ir reflected by the patches is detected by the light-receiving unit 102, thus obtaining an output voltage indicating the density of each patch 105 as a measurement result. At this time, the engine controller 22 controls the switching unit 21 to output the measurement result of the density sensor A 25. The engine controller 22 converts that measurement result, i.e., the output voltage from the density sensor A 25 into a density value.

In step S11, an optimal developing bias in the current environment is set.

Figure 4:
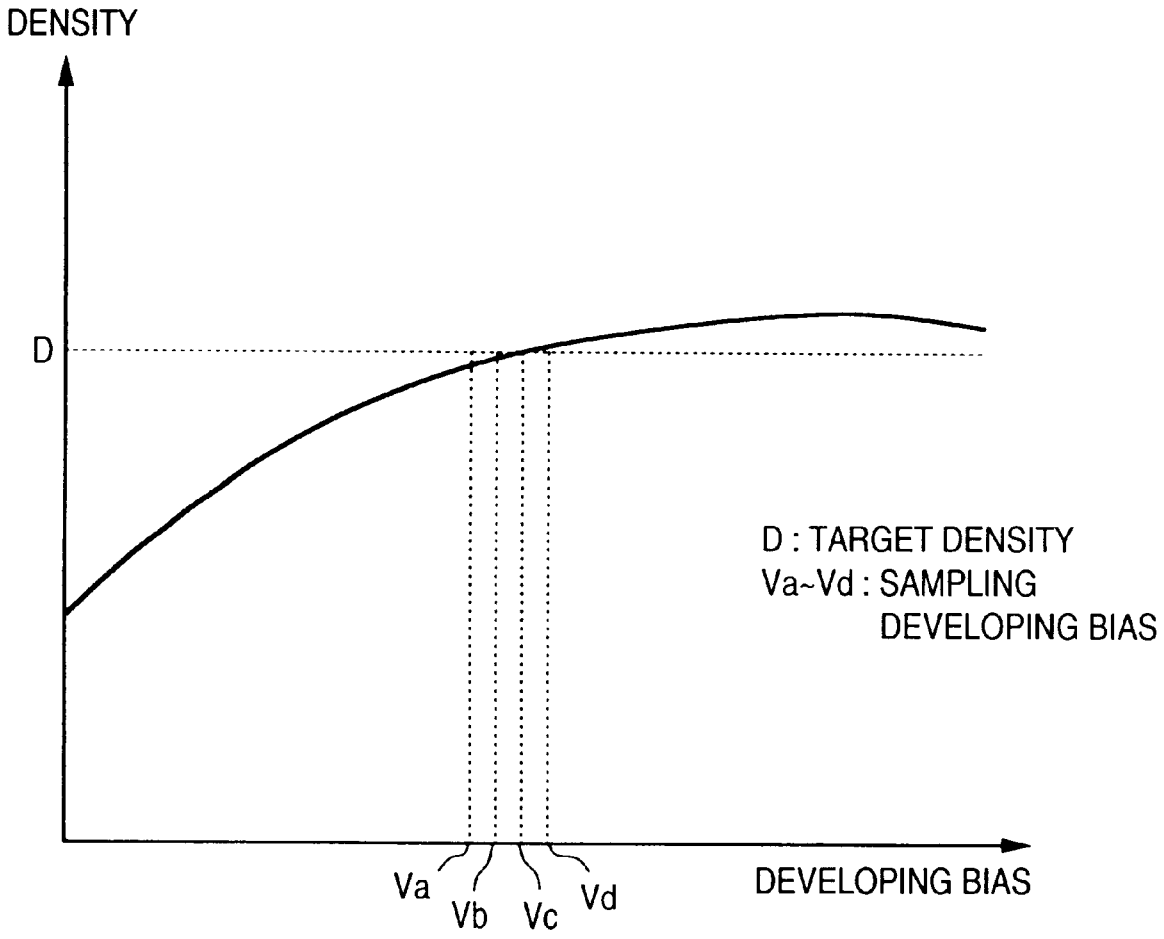
FIG. 4 is a graph showing bias voltage setups in the first embodiment.

FIG. 4 shows the relationship between the developing bias and density obtained in step S13. The curve shown in FIG. 4 is readily influenced by the number of prints and environmental changes such as changes in temperature, humidity, and the like, and a developing bias value corresponding to a predetermined target density D can be estimated based on this curve. For example, in case of FIG. 4, the developing bias value that can achieve the target density D is Vc. The obtained developing bias value is used as an optimal developing bias until the next density control process.

A case will be exemplified below wherein the "detailed print mode" is selected in step S11. In this case, patches 105 are formed on the intermediate transfer member 5 in step S14 as in the normal print mode described above. In step S15, the patches 105 are transferred onto a recording sheet 30 at the position of the transfer charger 6, and are fixed by the fixing unit 9. In step S16, the density sensor B 26 provided near the exhaust unit detects the patch densities on the conveyed recording sheet 30. After that, the flow advances to step S17, and an optimal developing bias is set by the same method as in the aforementioned normal print mode.

More specifically, the engine controller 22 controls the switching unit 21 to output the measurement result of the density sensor A 25 in the normal print mode, and to output the measurement result of the density sensor B 26 in the detailed print mode, and sets an optimal developing bias in the respective modes.

As described above, according to this embodiment, when the normal print mode is selected, an optimal developing bias is set without wasting any recording sheet. When the detailed print mode is set, the densities of the patches formed on the recording sheet are detected to execute more accurate density control, thus obtaining a high-quality image.

<Second Embodiment>

The second embodiment according to the present invention will be described below.

Figure 5:
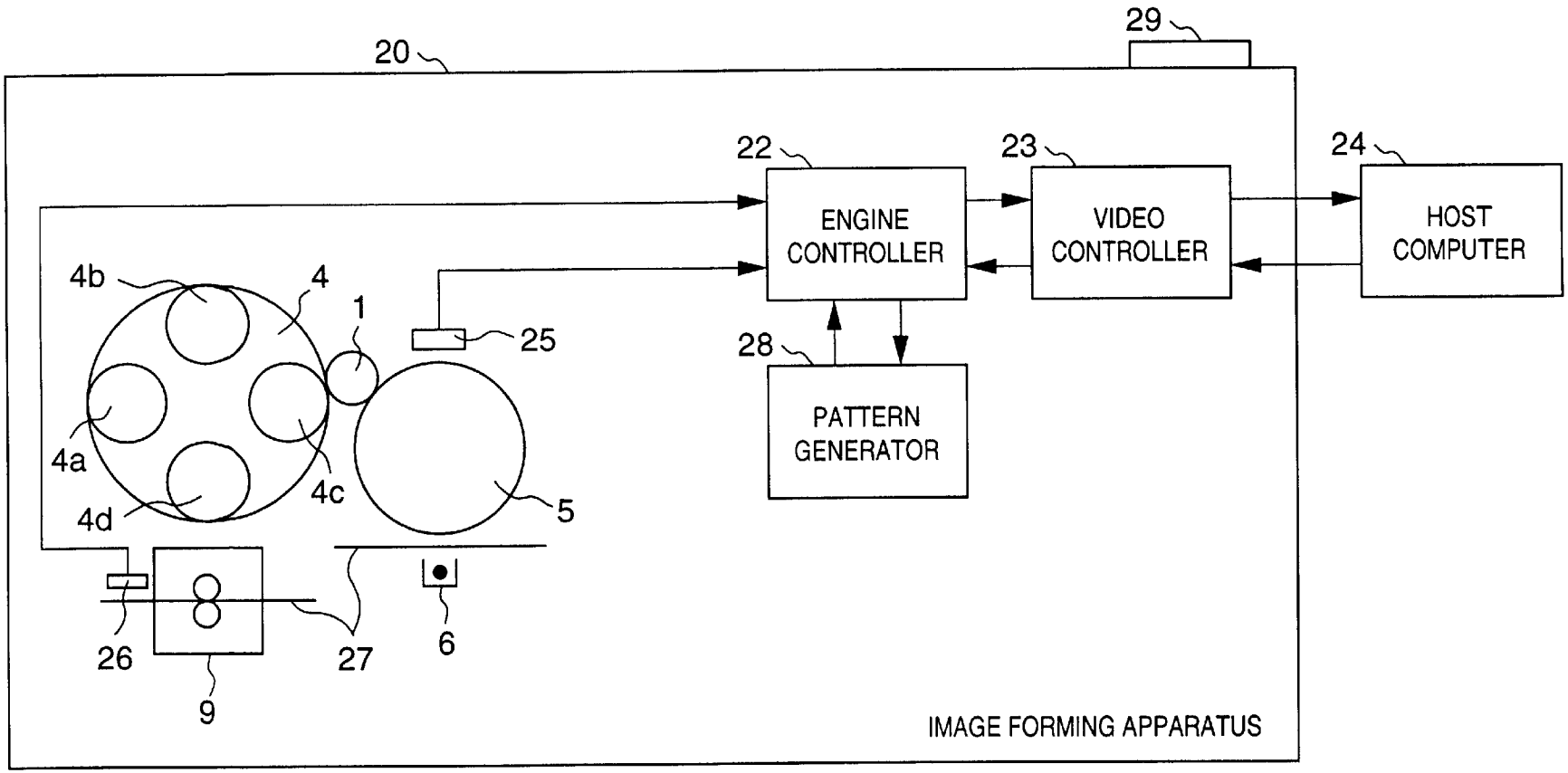
FIG. 5 is a block diagram showing the arrangement of an image forming apparatus according to the second embodiment of the present invention.

FIG. 5 is a block diagram showing the arrangement of an image forming apparatus in the second embodiment. The same reference numerals in FIG. 5 denote the same parts as in the arrangement shown in FIG. 1 in the first embodiment, and a detailed description thereof will be omitted. The arrangement shown in FIG. 5 is characterized in that the switching unit 21 in the arrangement shown in FIG. 1 is omitted.

The second embodiment has the "normal print mode" for performing density control using the density sensor A 25, and the "detailed print mode" for performing density control using the density sensor B 26 as well, and the engine controller 22 controls selection of these modes.

The density control process in the second embodiment will be described below.

A case will be explained below wherein the normal print mode is selected. In this case, as in the first embodiment described above, patches 105 shown in FIG. 3 are formed on the intermediate transfer member 5, and the density sensor A 25 obtains an output voltage indicating the density of each path 105 as a measurement result. The engine controller 22 converts the voltage value at a port connected to the output terminal of the density sensor A 25 into a density value, and estimates a developing bias value that can obtain a predetermined density in consideration of developing bias values corresponding to the individual patches 105.

A case will be explained below wherein the detailed print mode is selected. In this case, patches 105 formed on the intermediate transfer member 5 are transferred onto a recording sheet 30 at the position of the transfer charger 6, and are fixed by the fixing unit 9. The density sensor B 26 provided near the exhaust unit detects the patch densities on the conveyed recording sheet 30. The engine controller 22 converts the voltage value at a port connected to the output terminal of the density sensor B 26 into a density value, and estimates a developing bias value that can obtain a predetermined density in consideration of developing bias values corresponding to the individual patches 105.

More specifically, the engine controller 22 controls to receive the voltage value at the port connected to the output terminal of the density sensor A 25 in the normal print mode, and to receive that at the port connected to the output terminal of the density sensor B 26 in the detailed print mode. In either mode, the engine controller 22 sets an optimal developing bias voltage.

As described above, according to the second embodiment, the engine controller 22 itself selects one of the output voltages from the density sensors A 25 and A26, thus obtaining the same effect as in the first embodiment.

<Third Embodiment>

The third embodiment according to the present invention will be described below.

The arrangement of an image forming apparatus in the third embodiment is the same as that shown in FIGS. 1 and 3 in the first embodiment described above, and a detailed description thereof will be omitted.

The third embodiment has the "normal print mode" for performing density control using the density sensor A 25, and the "detailed print mode" for performing density control using the density sensor B 26 as well, and the engine controller 22 controls selection of these modes.

The density control process in the third embodiment will be explained below. The third embodiment is characterized in that density control based on laser exposure amount correction is done, and then, density control based on bias voltage setups is done as in the first embodiment.

A case will be explained below wherein the normal print mode is selected. In this case, a plurality of patches are formed on the intermediate transfer member 5 to have density differences by changing the laser exposure amount with respect to a pattern having a given density like the patches 105 shown in FIG. 3. As shown in FIG. 3, in the density sensor A 25, the patches on the intermediate drum 5 are irradiated with light rays Io from the light-emitting unit 101, and light Ir reflected by the patches is detected by the light-receiving unit 102, thus obtaining an output voltage indicating the density of each patch 105 as a measurement result. The measurement result is sent to the engine controller 22 via the switching unit 21.

The switching unit 21 is controlled by the engine controller 22 to output the measurement result of the density sensor A 25. The engine controller 22 converts the measurement result, i.e., the output voltage from the density sensor A 25.

Figure 6:
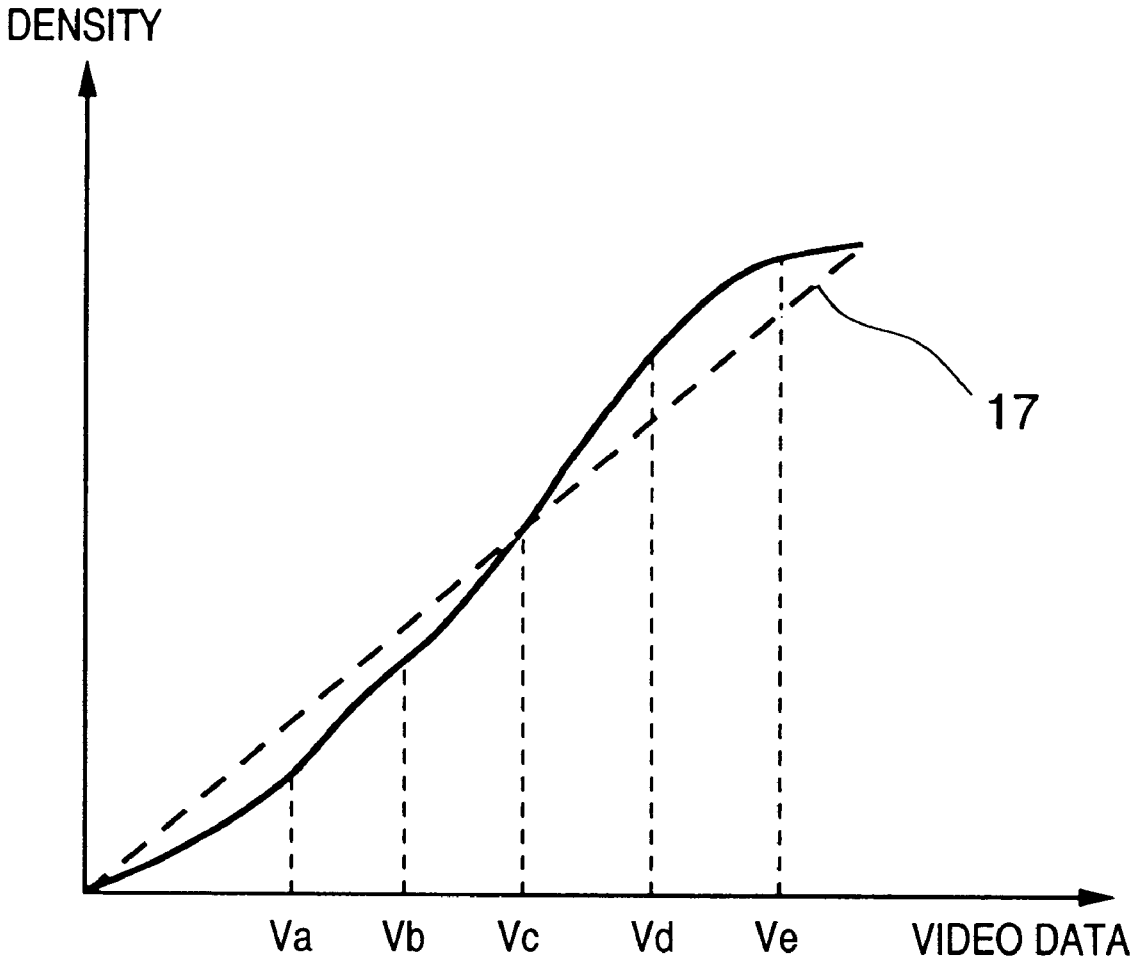
FIG. 6 is a graph showing the relationship between the laser exposure amount and density in the second embodiment.

FIG. 6 shows the relationship between the laser exposure amount and density obtained in this manner. Assume that in FIG. 6, the abscissa plots video data, and the density value plotted on the ordinate is obtained by laser exposure corresponding to the video data. As can be seen from FIG. 6, as video data, i.e., the laser exposure amount increases, the detected density value tends to become higher, but the laser exposure amount and density, i.e., the video data and density have a nonlinear relationship.

Hence, in the third embodiment, as indicated by a straight line 17 in FIG. 6, a laser exposure amount correction table for correcting the laser exposure amount to obtain a linear relationship between the video data and density is prepared. An actual print process is done based on that table. The obtained laser exposure amount correction table is used until the next density control process.

Upon completion of the density control based on laser exposure amount correction, density control based on bias voltage setups as in the first embodiment is executed. More specifically, a plurality of patches 105 are formed on the intermediate transfer member 5 to have density differences by changing the developing bias with respect to a pattern having a given density, as shown in FIG. 3, and the patch densities are measured by the density sensor A 25. The engine controller 22 converts the measurement result into a density value, and estimates a developing bias value that can obtain a predetermined density in consideration of developing bias values corresponding to the individual patches 105. The estimated value is set as an optimal developing bias at that time, and is used until the next density control process.

A case will be explained below wherein the detailed print mode is selected. In this case, a plurality of patches are formed on the intermediate transfer member 5 to have density differences by changing the laser exposure amount with respect to a pattern having a given density. As in the normal print mode, the density sensor A 25 detects the patch densities to prepare a laser exposure amount correction table. The obtained laser exposure amount correction table is used until the next density control process.

After that, a plurality of patches 105 are formed on the intermediate transfer member 5 to have density differences by changing the developing bias with respect to a pattern having a given density, as shown in FIG. 3, and are transferred onto a recording sheet 30 at the position of the transfer charger 6 and are fixed by the fixing unit 9. The density sensor B 26 detects the patch density on the conveyed recording sheet 30. Then, a developing bias value that can obtain a predetermined density is estimated by the same method as in the normal print mode. The estimated value is set as an optimal developing bias at that time, and is used until the next density control process.

More specifically, the engine controller 22 prepares a laser exposure amount correction table and sets an optimal developing bias voltage on the basis of the measurement value of the density sensor A 25 in the normal print mode. On the other hand, in the detailed print mode, the engine controller 22 prepares a laser exposure amount correction table based on the measurement value of the density sensor A 25, and sets an optimal developing bias voltage based on the measurement value of the density sensor B 26.

Note that the developing bias is set after the laser exposure amount correction table is prepared in the third embodiment. Of course, these processes may be done in a reverse order.

As described above, according to the third embodiment, when the normal print mode is selected, the laser exposure amount correction table and developing bias are set without using any recording sheet. When the detailed print mode is selected, the laser exposure amount correction table is prepared based on the densities of patches formed on the intermediate transfer member, and the bias voltage is set based on the densities of patches formed on the recording sheet to achieve density control, thus obtaining a higher-quality image.

<Modification of First to Third Embodiments>

When the detailed print mode is selected in the first to third embodiments mentioned above, a higher-quality image can be obtained if density control is done in units of prints, but continuous printing may be done. In this case, the density control interval may be defined by a predetermined time, a predetermined number of prints, or the like.

In each of the above embodiments, selection of the normal and detailed print modes is controlled by the engine controller 22 on the basis of a command or the like input from the video controller 23. Alternatively, the user may arbitrarily select one of these modes at the console 29. For example, whether or not one of a plurality of copy modes designated by the user corresponds to one or a plurality of copy modes which are set as the detailed print mode in advance can be checked to determine if the detailed print mode is set.

Also, whether or not the detailed print mode is set may be checked upon rendering video data and command received from the host computer 24 in the video controller 23.

In each of the above embodiments, the density control is done by controlling the developing bias or laser exposure amount. However, the present invention is not limited to such specific embodiments. For example, various other methods such as a method of forming patches by changing process conditions such as a photosensitive drum potential and the like, and making density control by setting optimal process conditions based on the detected density, a method of adjusting color process conditions such as gamma tables of individual color components and the like based on the detected density, and the like may be used.

In each of the above embodiments, in the normal print mode, the density sensor A 25 detects the densities of patches formed on the intermediate transfer member 5. Also, the present invention may be applied to an arrangement in which the density sensor A 25 is placed in the vicinity of the photosensitive drum 1 to measure the densities of patches formed on the photosensitive drum 1.

When the detailed print mode is selected in each of the above embodiments, more recording sheets are consumed than in the normal print mode. Hence, it is effective to build a system that charges fees in correspondence with, e.g., the number of prints when printing is done in the detailed print mode. Of course, when the present invention is applied to a system that also charges fees in the normal print mode, higher fees may be charged in the detailed print mode.

<Fourth Embodiment>

The fourth embodiment according to the present invention will be explained below.

Figure 9:
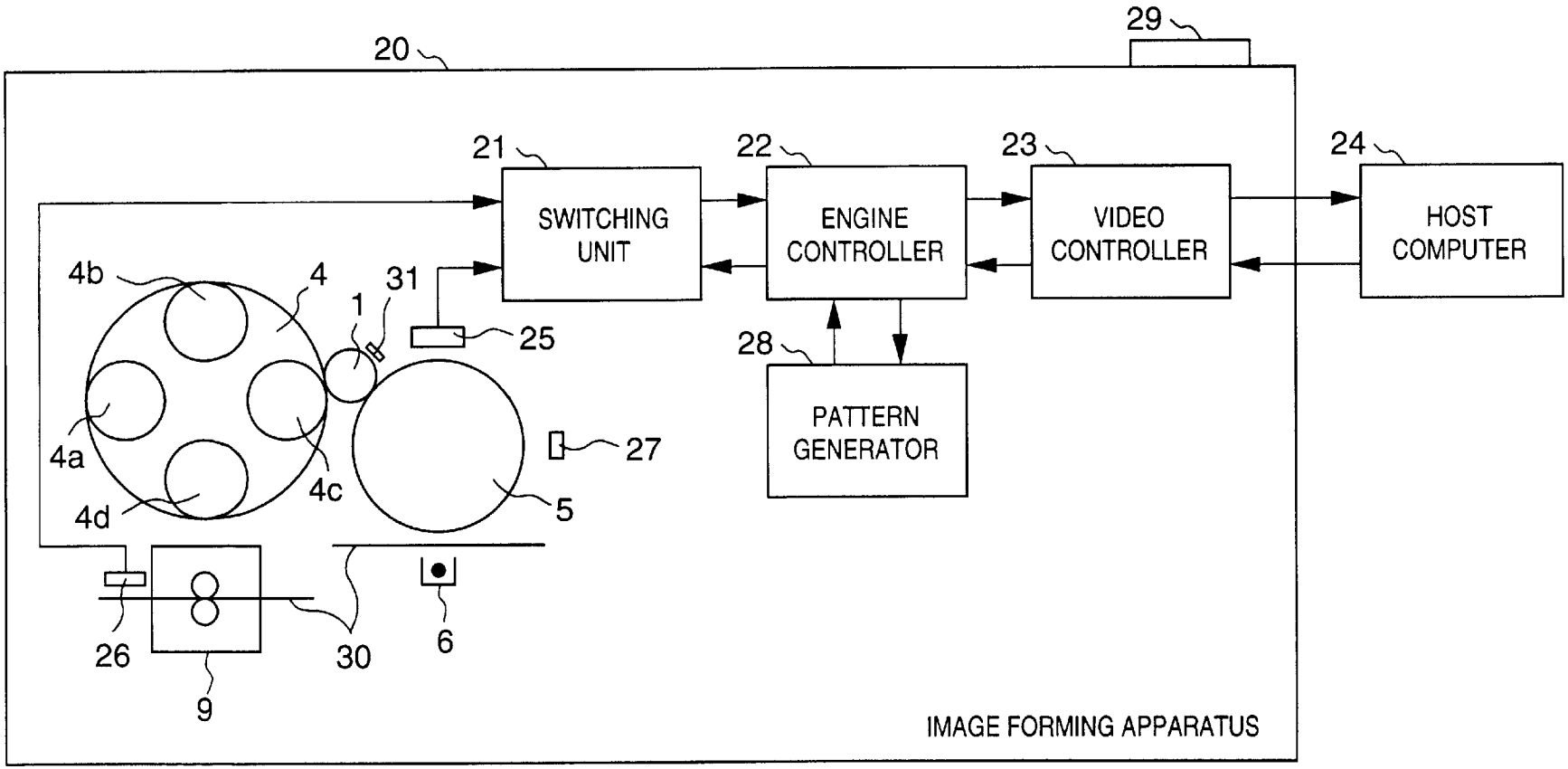
FIG. 9 is a block diagram showing the arrangement of an image forming apparatus according to the fourth embodiment of the present invention.

FIG. 9 is a block diagram showing the arrangement of an image forming apparatus in the fourth embodiment. The same reference numerals in FIG. 9 denote the same parts as those in the arrangement shown in FIG. 1 in the first embodiment, and a detailed description thereof will be omitted.

The arrangement shown in FIG. 9 is characterized in that a position sensor 27 for detecting the forming position of each color toner image on the intermediate transfer member 5 is added. Reference numeral 31 denotes a potential sensor for detecting the surface potential of the charged photosensitive drum 1. These sensors are used in various calibration processes in the fourth embodiment together with the density sensors A 25 and B 26.

Calibration processes executed in the fourth embodiment include density control that obtains an optimal image density by tentatively forming respective color patches on the photosensitive drum 1 or intermediate transfer member 5, detecting their densities using the density sensor A 25 or B 26, and varying image forming conditions such as an exposure amount, developing bias, and the like on the basis of the detection result.

The calibration processes also include registration control that forms position detection patches of respective colors on the intermediate transfer member 5, and corrects image forming positions of the respective colors by detecting the positional relationship of the patches using the position sensor 27.

Furthermore, the calibration processes include developing bias control that uniformly charges the photosensitive drum 1 by the charger 3, detects the degree of deterioration of the photosensitive drum 1 by measuring the charged potential of the photosensitive drum 1 at that time, and adjusts the charging bias value.

Moreover, the calibration processes in the fourth embodiment are not limited to only control that pertains to the image forming processes in a printer engine, but can also be extended to output grayscale level correction that adjusts color process conditions such as gamma tables and the like on the basis of the patch density values and the like detected by the aforementioned method in units of color components in the video controller 23.

The fourth embodiment is characterized by comprising a "normal print mode" that executes calibration at a predetermined timing (e.g., every predetermined number of pints, upon power ON, or the like), and a "specific print mode" that forcibly executes calibration immediately before every print process. When calibration is forcibly executed in the specific print mode, the calibration execution timing in the normal print mode is reset.

The print process in the fourth embodiment will be explained below with reference to the flow chart in FIG. 10. Note that the process shown in that flow chart is implemented by the engine controller 22.

It is checked in step S101 if the specific print mode is set. If the specific print mode is not set, the flow jumps to step S109 to execute a normal print process. On the other hand, if the specific print mode is set, a print process is started after calibration is forcibly executed.

Whether or not the specific print mode is set is determined based on a command input from the host computer 24, as described above. Hence, the video controller 23 may make this determination. In this case, if the specific print mode is set, the video controller 23 outputs to the engine controller 22 a command indicating that calibration is forcibly executed.

In the specific print mode, the engine controller 22 resets the number N of trials of calibration to 1 in step S102, and executes calibration (first calibration) in step S103. In this case, as the calibration, after it is checked if the individual units that pertain to the image forming processes are normal, a normal density control sequence and print position adjustment sequence are executed.

When a print job is being executed at the time when the image forming apparatus 20 is set in the specific print mode, the calibration is executed after the print job ends normally.

Upon completion of the calibration, it is checked in step S104 if a test print execution mode is set. This mode is also set based on a command input from the host computer 24, but may be directly set by the user at the console 29. Upon setting the test print mode, an upper limit M of the number N of trials of calibration can also be set.

If no test print mode is set, the flow jumps to step S109 to make a print process that reflects the calibration result; if the test print mode is set, the flow advances to step S105 to execute the test print mode. If the user is satisfied with the test print result in step S106, the flow jumps to step S109 to make a print process that reflects the calibration result. Note that checking in step S106 is also done based on a command input from the host computer 24 but the user may directly input the checking result at the console 29.

On the other hand, if the user is not satisfied with the test print result in step S106, calibration is executed again. After it is confirmed in step S107 if the number N of trials of calibration is equal to or smaller than the upper limit M, N is incremented in step S108, and the flow returns to step S103 to execute the calibration again. In this case, the parameters in the calibration are changed in correspondence with N. In this manner, if the user is satisfied with the result before the calibration is executed M times, a print process that reflects an appropriate calibration result can be done in step S109.

If N>M in step S107, i.e., if no satisfactory print result is obtained even after calibration is executed a maximum number of times, the print process in the specific print mode is stopped. In this case, the user is informed of a message indicating that a normal print process can be made but not in the specific print mode, and if he or sets the normal print mode, the normal print process is executed.

Figure 10:
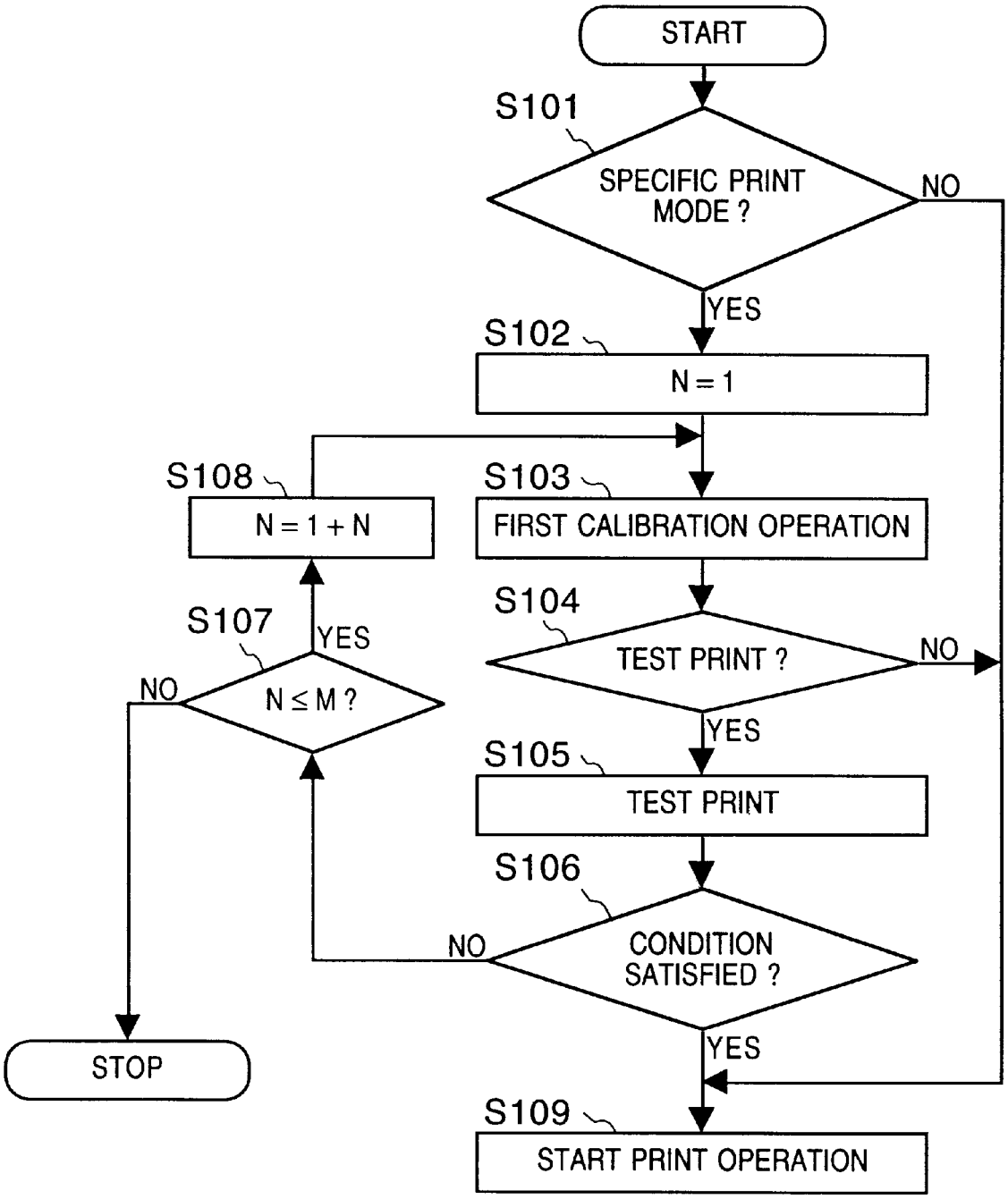
FIG. 10 is a flow chart showing a print process in the fourth embodiment.

Although not shown in FIG. 10, in addition to the normal print mode and specific print mode, the detailed print mode as in the first to third embodiments may be selected at the same time. That is, when the normal print mode is set, calibration is done based on the densities of patches on the intermediate transfer member 5, which are detected by the density sensor A 25; when the detailed print mode is set, calibration is done based on the densities of patches on the recording sheet 30, which are detected by the density sensor B 26.

As described above, according to the fourth embodiment, when the specific print mode is set, since calibration is forcibly executed, the user can arbitrarily control the calibration execution timing. Hence, a high-quality image can be stably obtained at a timing that the user desires.

For example, upon executing a series of print processes for copying a single original in a large quantity, when the print job is executed in the specific print mode, the calibration is forcibly executed immediately before the print process starts actually. Hence, the calibration can be prevented from being started in the middle of a job.

In the fourth embodiment, in the normal print mode, calibration is done at a predetermined timing as in the conventional apparatus. For example, the calibration may be done only when the specific print mode is set. Also, a print mode without any calibration may be added. In this manner, a print process that does not require high image quality is executed in the mode without any calibration, thus shortening the print time.

<Fifth Embodiment>

The fifth embodiment according to the present invention will be described below. Since the arrangement of an image forming apparatus in the fifth embodiment is the same as that shown in FIG. 9 in the fourth embodiment, a detailed description thereof will be omitted.

The fifth embodiment is characterized in that a more accurate calibration process which can arbitrarily set its details is done in addition to normal calibration. Also, the fifth embodiment is characterized in that if calibration cannot be executed satisfactorily, the user is informed of a message indicating this.

Figure 11:
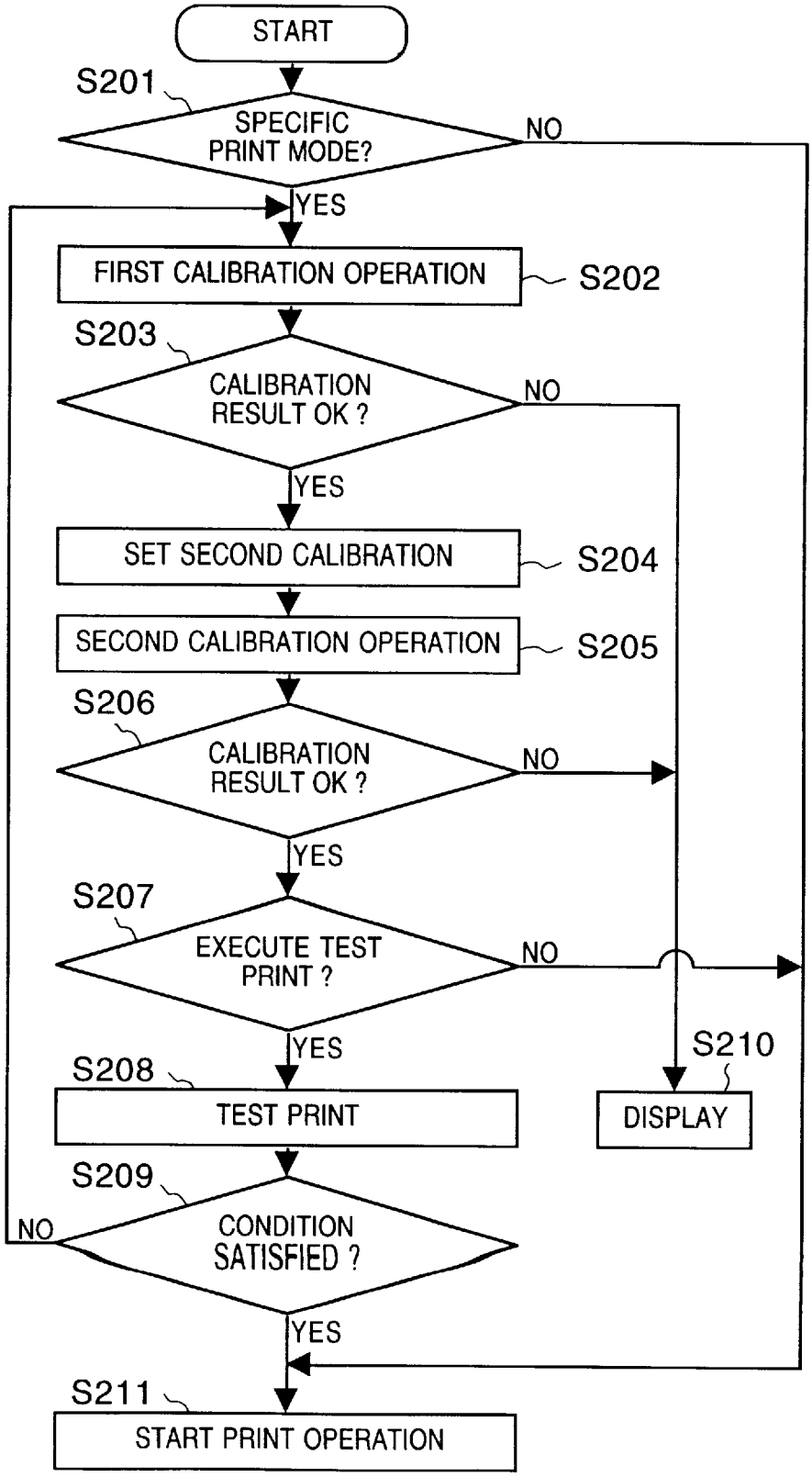
FIG. 11 is a flow chart showing a print process in the fifth embodiment of the present invention.

The print process in the fifth embodiment will be explained below with reference to the flow chart in FIG. 11. Note that the process shown in that flow chart is implemented by the engine controller 22.

It is checked in step S201 if the specific print mode is set. This checking is done based on a command input from the host computer 24 or an input at the console 29 as in the fourth embodiment. If the specific print mode is not set, the flow jumps to step S211 to execute a print process including a normal calibration process that has been explained in the first to third embodiments. On the other hand, if the specific print mode is set, a print process is started after calibration is forcibly executed.

In the specific print mode, first calibration is executed in step S202. Note that the first calibration is done based on general density control, registration correction, bias control, or the like.

It is checked in step S203 if the first calibration result is normally obtained or if the result is appropriate. In this case, various checking methods may be used. For example, it may be determined that a normal and appropriate result is obtained, unless the calibration terminates abnormally, or checking may be done after a test print process.

If an appropriate calibration result cannot be obtained, a message indicating this is displayed on a display of the console 29 in step S210, thus warning the user that it is impossible to execute the specific print mode. In this case, since a print process in the normal print mode can be executed, a message indicating that the normal print mode can be executed is also displayed. After that, only a print job in the normal print mode is accepted.

Note that the message display may be implemented as a response to a print execution command from the host computer 24. In this case, the host computer 24 can display a corresponding message on its printer driver window or the like on the basis of a response sent back via the video controller 23.

If the first calibration result is normally obtained, details of second calibration are set in step S204. As the setting method, for example, a method of allowing the user to arbitrarily make setups on the printer driver window on the host computer 24, and sending a command that indicates the setup contents to the image forming apparatus 20, a method of making setups at the console 29, and the like may be used.

Note that the second calibration is required to obtain a more accurate result under stricter conditions, although substantially the same processes as in the first calibration are done. For example, in calibration that performs density control by measuring the densities of patches formed on the intermediate transfer member 5, the second calibration forms a larger number of patches than in the first calibration to measure their densities, thus improving linearity of tone reproduction characteristics. Also, in the second calibration, a process which is not included in the first calculation may be additionally done. For example, when the first calibration performs density control, the second calibration may additionally perform fixing temperature control for narrowing down the fixing heating temperature range in the fixing unit 9 by detecting its maximum and minimum values in addition to the density control.

In step S205, the second calibration set in step S204 is executed. It is then checked in step S206 if the second calibration result is normally obtained or if the calibration result is appropriate.

If an appropriate calibration result cannot be obtained, a message indicating this is displayed on the display of the console 29 in step S210, thus informing the user that it is impossible to execute the specific print mode with the set calibration process. In this case, since a print process in the normal print mode can be executed, a message indicating that the normal print mode can be executed is also displayed. After that, only a print job in the normal print mode is accepted. In this case, message display may be implemented by displaying a corresponding message on the printer driver window of the host computer 24.

If the second calibration result is normally obtained, it is checked in step S207 if a test print execution mode is set. This mode is also set based on a command input from the host computer 24, but may be directly set by the user at the console 29.

If no test print mode is set, the flow jumps to step S211 to execute a print process that reflects the first and second calibration results; if the test print mode is set, the flow advances to step S208 to execute the test print mode. If the user is satisfied with the test print result in step S209, the flow advances to step S211 to execute a print process that reflects the first and second calibration results. Note that checking in step S209 is done based on a command input from the host computer 24, but the user may directly input the checking result at the console 29 instead.

On the other hand, if the user is not satisfied with the test print result in step S209, the flow returns to step S202 to repeat the sequence from the first calibration. In this case, the parameters in the first and second calibration processes may be automatically varied in correspondence with the number of trials or the details of the second calibration may be set again in step S204.

In the fifth embodiment as well, the upper limit of the number of trials of calibration may be determined as in the fourth embodiment, and when no satisfactory calibration result is obtained within a prescribed number of times of calibration, that message may be displayed to end the process or a print process may be executed in the normal print mode.

In the fifth embodiment, the sequence is repeated from the first calibration until a satisfactory calibration result is obtained. Alternately, the second calibration alone may be repeated. Also, the user may select whether the sequence is re-executed from the first or second calibration.

As described above, according to the fifth embodiment, since a more accurate calibration process is done in addition to a normal calibration process, a higher-quality print can be stably realized. Since details of the accurate calibration can be arbitrarily set, a print image with image quality that matches particular user's need can be provided.

If a calibration process cannot be satisfactorily done, a message indicating this is displayed. Hence, the user can switch the print mode to the normal print mode as needed to execute the job, thus allowing flexible control.

<Sixth Embodiment>

The sixth embodiment according to the present invention will be explained below.

Since the arrangement of an image forming apparatus in the fifth embodiment is the same as that shown in FIG. 9 in the fourth embodiment, a detailed description thereof will be omitted.

The sixth embodiment is characterized by assuring a dedicated page memory to minimize image omission upon image rendering when the specific print mode is set.

Figure 12:
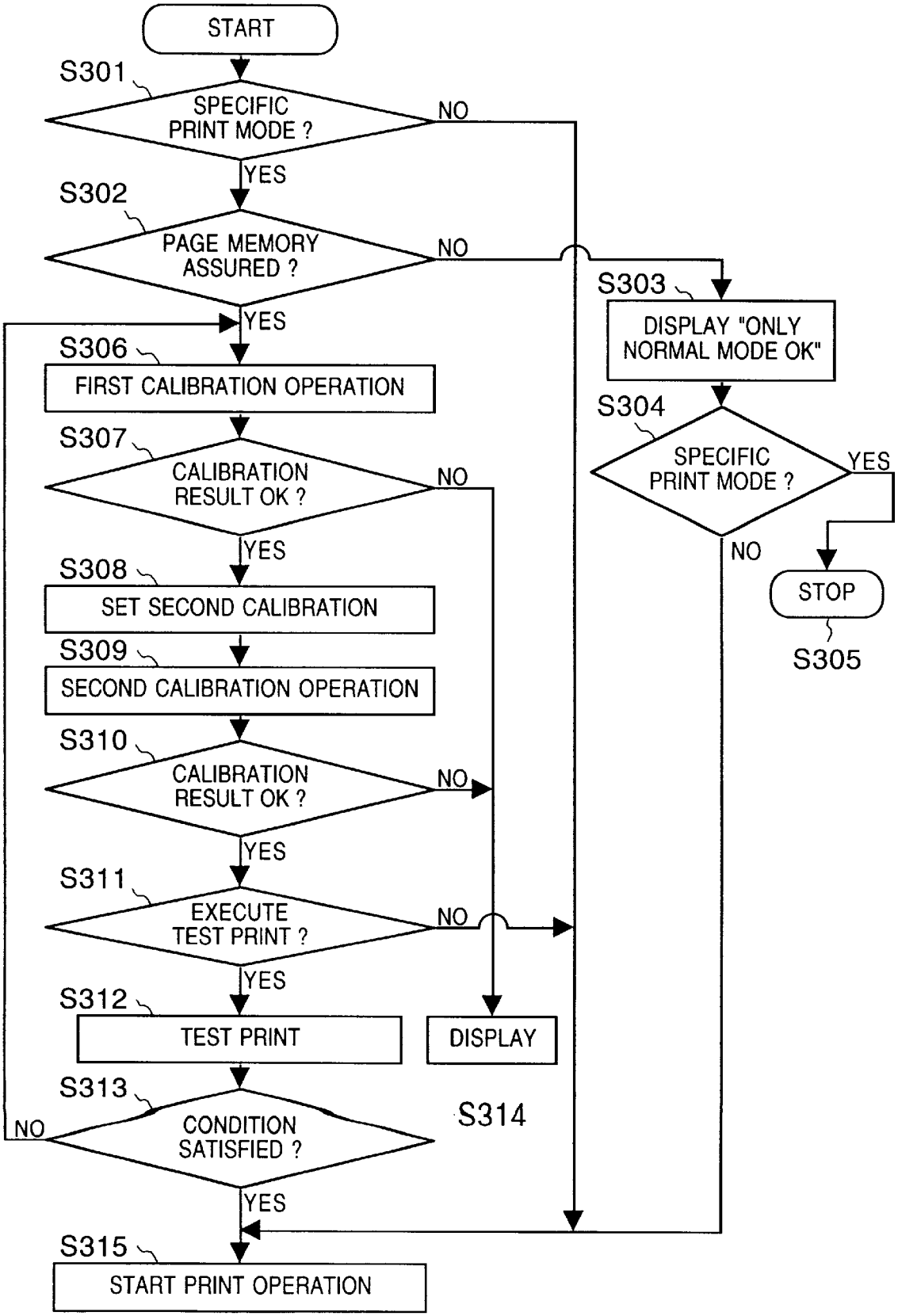
FIG. 12 is a flow chart showing a print process in the sixth embodiment of the present invention.

The print process in the sixth embodiment will be described below with reference to the flow chart shown in FIG. 12. Note that the process shown in that flow chart is implemented by the engine controller 22 and video controller 23.

The video controller 23 checks in step S301 if the specific print mode is set. This checking is done based on a command input from the host computer 24 or an input at the console 29. If the specific print mode is not set, the flow jumps to step S315 to execute a print process including a normal calibration process that has been explained in the first to third embodiments. On the other hand, if the specific print mode is set, a print process in the following specific print mode is started.

In the specific print mode, the video controller 23 checks its own memory size and assures a page memory required for rendering an image in the specific print mode in step S302. In this case, image data is rendered in the bitmap format.

If the required memory size cannot be assured, the flow advances to step S303. In step S303, the video controller 23 informs the engine controller 22 that the required memory size cannot be assured, and the engine controller 22 displays a message indicating that the specific print mode cannot be executed, and a message indicating that the normal print mode can be executed on the display of the console 29, thus informing the user of the situation.

Note that such message display may be implemented as a response to a print execution command from the host computer 24. In this case, the host computer 24 can display a corresponding message on its printer driver window or the like on the basis of a response sent back via the video controller 23.

After that, the engine controller 22 checks in step S304 if a user instruction input in response to the message is a print instruction in the normal print mode. If the specific print mode is set again, the engine controller 22 stops the print process. On the other hand, if the normal print mode is set, the flow advances to step S315 to execute a print process in the normal print mode. In this case, the display of the console 29 or the printer driver window of the host computer 24 displays a message indicating that the current print process is done in the normal print mode.

On the other hand, if the required memory size can be assured in step S302, the video controller 23 sends a command for forcibly executing a calibration process to the engine controller 22, thus starting a print process in the specific print mode (steps S306 to S315). Note that the specific print process in the sixth embodiment is the same as that in steps S202 to S211 in FIG. 11 in the fifth embodiment, and a detailed description thereof will be omitted.

As described above, according to the sixth embodiment, since a memory size sufficient for image rendering is assured before the print process, image data can be prevented from being lost upon rendering. Hence, an image within one page can be completely reproduced, and a high-quality print that satisfactorily reflects the calibration result can be stably realized.

In the sixth embodiment, video data is rendered in the bitmap format, but may be rendered in other formats. For example, a page memory may be assured to hold video data compressed by a given coding scheme such as runlength, MR, MMR, or the like, or video data may be held as intermediate image data unique to the image forming apparatus 20. In this manner, the memory size to be assured can be reduced.

<Modification of Sixth Embodiment>

In the sixth embodiment, when the required memory size cannot be assured, a message indicating that no print process in the specific print mode can be executed, and a print process in the normal print mode can be executed is displayed on the console 29 (S303).

In this modification, if the required memory size cannot be assured, a message indicating that no print process in the specific print mode can be executed, but may be allowed if an expanded memory is additionally installed is displayed on the console 29, thus informing the user. The user then installs an expanded memory in the image forming apparatus 20 in accordance with that message, and instructs re-execution of the print process in the specific print mode. If the required memory size can be assured by adding the memory, the print process can be done in the specific print mode.

The message display may be implemented as a response to a print execution command from the host computer 24. In this case, a message that prompts the user to install an expanded memory may be displayed on the printer driver window of the host computer 24 on the basis of the response.

Upon receiving the response by the host computer 24, its internal printer driver may assure a memory size that can be used in the host computer, i.e., a memory for the print process for the specific print mode. Note that the memory may comprise a volatile memory such as a DRAM or the like, or a nonvolatile memory such as a hard disk or the like. By holding the image information rendered in the bitmap format in the memory, image data that cannot be held by the image forming apparatus 20 side can be held on the host computer 24 side. Upon printing after calibration, the printer driver in the host computer 24 can sequentially send video data held in the internal memory in units that can be processed by the image forming apparatus 20.

<Other Embodiments>

In each of the above embodiments, an image forming apparatus which comprises a single photosensitive drum, and obtains a color image by repeating an image forming process including charging, exposure, development, and transfer a plurality of number of times has been exemplified. However, the present invention is not limited to such specific apparatus, but may be applied to an image forming apparatus which comprises a plurality of image forming means (photosensitive drums), and obtains a color image by superposing a plurality of color toner images on an intermediate transfer member or recording sheet. Note that the intermediate transfer member is not limited to a cylindrical shape but may have a belt-like shape.

In each of the above embodiments, an image is formed based on video data transferred from the external host computer 24. For example, the present invention can be similarly applied to, e.g., a copying machine which includes a scanner for scanning an original image.

The detailed and specific modes in each of the above embodiments are those for compensating color reproducibility with higher accuracy than in the normal mode. For example, these modes correspond to a mode used when no misprint is allowed such as a print process of paid image information downloaded from the Web, a mode for a proof process, and the like.

Note that the present invention may be applied to either a system constituted by a plurality of devices (e.g., a host computer, an interface device, a reader, a printer, and the like), or an apparatus consisting of a single equipment (e.g., a copying machine, a facsimile apparatus, or the like).

The objects of the present invention are also achieved by supplying a storage medium, which records a program code of a software program that can implement the functions of the above-mentioned embodiments to the system or apparatus, and reading out and executing the program code stored in the storage medium by a computer (or a CPU or MPU) of the system or apparatus.

In this case, the program code itself read out from the storage medium implements the functions of the above-mentioned embodiments, and the storage medium which stores the program code constitutes the present invention.

As the storage medium for supplying the program code, for example, a floppy disk, hard disk, optical disk, magneto-optical disk, CD-ROM, CD-R, magnetic tape, nonvolatile memory card, ROM, and the like may be used.

The functions of the above-mentioned embodiments may be implemented not only by executing the readout program code by the computer but also by some or all of actual processing operations executed by an OS (operating system) running on the computer on the basis of an instruction of the program code.

The present invention also includes a product, e.g., a print obtained by the image processing method of the present invention.

Furthermore, the functions of the above-mentioned embodiments may be implemented by some or all of actual processing operations executed by a CPU or the like arranged in a function extension board or a function extension unit, which is inserted in or connected to the computer, after the program code read out from the storage medium is written in a memory of the extension board or unit. When the present invention is applied to the storage medium, the storage medium stores program codes corresponding to the aforementioned flow charts (FIGS. 2, 10, 11, and 12).

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

image forming means for forming an image on an image carrier, and transferring the image onto a recording sheet;

test image forming means for making said image forming means form a test image;

first density detecting means for detecting a density of the test image formed on the image carrier;

second density detecting means for detecting a density of the test image formed on the recording sheet; and control means for controlling an image forming condition in said image forming means, wherein said control means controls the image forming condition by selectively using said first or second density detecting means in accordance with a control mode based on a user instruction.

2. The apparatus according to claim 1, wherein said control means controls the image forming condition on the basis of the densities detected by said first and second density detection means when the second mode is set as the control mode.

3. The apparatus according to claim 1, wherein the image forming condition is a color process condition.

4. The apparatus according to claim 1, wherein the image forming condition is a developing bias voltage upon developing an image on the image carrier.

5. The apparatus according to claim 1, wherein the image forming condition is a laser exposure amount upon exposing the image carrier on the basis of an image signal.

6. The apparatus according to claim 1, wherein the image forming condition is a charging amount of the image carrier.

7. The apparatus according to claim 1, wherein said second density detection means detects a density of a patch which is formed and fixed on the recording sheet.

8. The apparatus according to claim 1, further comprising charging means for charging a fee in correspondence with the number of images formed, and wherein said charging means charges a fee higher than a fee in the first mode when the second mode is set.

9. An image forming apparatus comprising:

image forming means for forming an image on an image carrier, and transferring the image onto a recording sheet;

test image forming means for making said image forming means form a test image;

first density detection means for detecting a density of the test image formed on the image carrier;

second density detection means for detecting a density of the test image formed on the recording sheet; and control means for controlling an image forming condition in said image forming means, wherein said control means has a first mode for controlling the image forming condition at a predetermined timing in accordance with the density detected by said first density detection means, a second mode for controlling the image forming condition at a predetermined timing in accordance with the density detected by said second density detection means, and a third mode for controlling the image forming condition at an arbitrary timing, and said control means selects one of the first to third modes on the basis of a user instruction.

10. A control method for controlling an image forming condition fo an image forming apparatus for transferring an image formed on an image carrier onto a recording sheet, having a first mode for controlling the image forming condition on the basis of a measurement result of an image formed on the image carrier, and a second mode for controlling the image forming condition on the basis of a measurement result of an image formed on the recording sheet, wherein one of the first or second modes is selected in accordance with an output mode based on a user instruction.

11. The method according to claim 10, wherein the image forming condition is a color process condition.

12. A storage medium which records a control program for controlling an image forming condition of an image forming apparatus for transferring an image formed on an image carrier onto a recording sheet, said control program including:

a code of a first mode for controlling the image forming condition on the basis of a measurement result of an image formed on the image carrier;

a code of a second mode for controlling the image forming condition on the basis of a measurement result of an image formed on the recording sheet; and a code of selecting one of the first or second modes in accordance with an output mode based on a user instruction.

13. An image forming apparatus comprising:

image forming means for forming an image on the basis of an image signal;

calibration means for detecting a density of a test image formed by said image forming means and executing a calibration process which controls an image forming condition in said image forming means on the basis of the detected density at a predetermined timing; and control means for controlling said calibration means and image forming means to initiate an image forming process after performing a calibration process forcibly executed regardless of said predetermined timing when the image forming process in a first image forming mode is instructed to be performed, and to initiate an image forming process without performing the forced calibration process executed regardless of said predetermined timing when the image forming process in a second image forming mode is instructed to be performed.

14. The apparatus according to claim 13, wherein the forced calibration process is executed with higher accuracy than the calibration process executed at the predetermined timing.

15. The apparatus according to claim 13, wherein the image forming condition is a process condition for forming a color image.

16. The apparatus according to claim 13, wherein, in a case where a test print is set to be performed after performing the forced calibration process in said first image forming mode, said control means controls said calibration means to repeat the forced calibration process in accordance with the test print result.

17. The apparatus according to claim 16, wherein, in a case where the test print results are not satisfactory after repeating the forced calibration process predetermined number of times, said control means prevents said image forming means from executing the image forming process in said first image forming mode.

18. A control method for controlling an image forming condition of an image forming apparatus, comprising the steps of:

detecting a density of a test image formed by said image forming apparatus and executing a calibration process which controls the image forming condition in said image forming apparatus on the basis of the detected density at a predetermined timing;

controlling to initiate an image forming process after performing a calibration process forcibly executed regardless of said predetermined timing when the image forming process in a first image forming mode is instructed to be performed; and controlling to initiate an image forming process without performing the forced calibration process executed regardless of said predetermined timing when the image forming process in a second image forming mode is instructed to be performed.

19. The control method according to claim 18, wherein the forced calibration process is executed with higher accuracy than the calibration process executed at the predetermined timing.

20. The control method according to claim 18, wherein the image forming condition is a process condition for forming a color image.

21. The control method according to claim 18, further comprising a step of executing test print after the forced calibration process.

22. The control method according to claim 21, further comprising the step of repeating the forced calibration process in accordance with a test print result.

23. The control method according to claim 22, further comprising a step of preventing the image forming process in said first image forming mode from being performed in a case where the test print results are not satisfactory after repeating the calibration process predetermined number of times.

24. A storage medium which records a control program for controlling an image forming condition of an image forming apparatus, said control program including the codes of:

detecting a density of a test image formed by said image forming apparatus and executing a calibration process which controls the image forming condition in said image forming apparatus on the basis of the detected density at a predetermined timing;

controlling to initiate an image forming process after performing a calibration process forcibly executed regardless of said predetermined timing when the image forming process in a first image forming mode is instructed to be performed; and controlling to initiate an image forming process without performing the forced calibration process executed regardless of said predetermined timing when the image forming process in a second image forming mode is instructed to be performed.

* * * * *

UNITED STATES PATENT AND TRADEMARK OFFICE

CERTIFICATE OF CORRECTION

PATENT NO. : 6,243,542 B1
DATED : June 5, 2001
INVENTOR(S) : Akihiro Fujimoto et al.

It is certified that error appears in the above-identified patent and that said Letters Patent is hereby corrected as shown below:

Column 5,
Line 2, “shows” should read -- show --; and
Line 65, “form” should read -- from --.

Column 6,
Line 11, “S11,” should read -- S17, --.

Column 11,
Line 29, after “or”, please insert -- she --.

Column 17,
Line 35, “fo” should read -- of --.

Signed and Sealed this

Fifteenth Day of November, 2005

JON W. DUDAS
*Director of the United States Patent and Trademark Office*